US007172412B2

(12) United States Patent
Platvoet et al.

(10) Patent No.: US 7,172,412 B2
(45) Date of Patent: Feb. 6, 2007

(54) PYROLYSIS HEATER

(75) Inventors: Erwin M. J. Platvoet, Siggenthal Station (CH); Robert John Gartside, Summit, NJ (US); Peter Robert Ponzi, Randolph, NJ (US); Paul Chapman, Windsor, CT (US); Frank D. McCarthy, Wayne, NJ (US)

(73) Assignee: ABB Lummus Global Inc., Bloomfield, NJ (US)

( * ) Notice: Subject to any disclaimer, the term of this patent is extended or adjusted under 35 U.S.C. 154(b) by 351 days.

(21) Appl. No.: 10/717,087

(22) Filed: Nov. 19, 2003

(65) Prior Publication Data

US 2005/0106518 A1 May 19, 2005

(51) Int. Cl.

| | |
|---|---|
| ***B01J 10/10*** | (2006.01) |
| ***B01J 8/04*** | (2006.01) |
| ***C10G 9/14*** | (2006.01) |
| ***C10G 9/36*** | (2006.01) |
| ***F27B 7/00*** | (2006.01) |

(52) U.S. Cl. ..... 431/9; 431/8; 431/348; 431/174; 431/178; 422/78; 422/198; 122/240.1; 122/356; 126/92 C; 126/109; 196/116

(58) Field of Classification Search ..... 431/8, 431/159, 171, 174, 175, 178, 179, 348, 349; 422/78, 276, 333, 356, 198; 122/240.1, 276, 122/333, 356; 126/109, 92 R, 92 AC, 92 C; 432/31, 175; 196/110, 116

See application file for complete search history.

(56) References Cited

U.S. PATENT DOCUMENTS

| | | | | |
|---|---|---|---|---|
| 3,028,907 | A * | 4/1962 | Hensel | 431/116 |
| 3,101,769 | A * | 8/1963 | Zink et al. | 431/175 |
| 3,230,052 | A * | 1/1966 | Lee et al. | 422/197 |
| 3,240,204 | A | 3/1966 | von Wiesenthal | |
| 3,274,978 | A * | 9/1966 | Palchik et al. | 122/356 |
| 3,425,781 | A * | 2/1969 | Bitterlich | 431/178 |
| 3,957,420 | A * | 5/1976 | Asai et al. | 431/175 |
| 4,166,434 | A * | 9/1979 | Jensen et al. | 122/356 |
| 4,412,975 | A * | 11/1983 | Parizot et al. | 422/197 |
| 4,955,323 | A * | 9/1990 | Ziemianek | 122/4 D |
| 5,823,769 | A * | 10/1998 | Joshi et al. | 432/181 |
| 6,193,940 | B1 * | 2/2001 | Kang et al. | 422/198 |
| 6,425,757 | B1 * | 7/2002 | Chapman et al. | 432/146 |
| 6,685,893 | B2 * | 2/2004 | Platvoet et al. | 422/198 |
| 2002/0155046 | A1 | 10/2002 | Platvoet et al. | 422/192 |

FOREIGN PATENT DOCUMENTS

| | | | |
|---|---|---|---|
| DE | 1558559 | * | 4/1970 |
| EP | 1 211 458 A2 | | 6/2002 |
| JP | 01-266407 | * | 10/1989 |

* cited by examiner

*Primary Examiner*—Carl D. Price
(74) *Attorney, Agent, or Firm*—Alix, Yale & Ristas, LLP

(57) ABSTRACT

A pyrolysis heater particularly for the cracking of hydrocarbons in the production of olefins has a burner arrangement in the firebox which includes staged combustion low $NO_x$ hearth burners firing upwardly in the firebox adjacent to the walls. Wall stabilizing gas fuel injection tips, located at an elevation above the hearth burners, inject fuel upwardly between the walls and the flame from the hearth burners. This prevents rollover of the flame onto the process heater coil and overheating of the coil.

15 Claims, 9 Drawing Sheets

PYROLYSIS HEATER

BACKGROUND OF THE INVENTION

The present invention relates to a heater for the pyrolysis of hydrocarbons and particularly to a heater for the steam cracking of paraffins to produce olefins. In particular, the invention relates to a firing arrangement to prevent flame rollover and impingement on the process coils most particularly for staged combustion for low $NO_x$ production.

The steam cracking or pyrolysis of hydrocarbons for the production of olefins is almost exclusively carried out in tubular coils located in fired heaters. The pyrolysis process is considered to be the heart of an olefin plant and has a significant influence on the economics of the overall plant.

The hydrocarbon feedstock may be any one of the wide variety of typical cracking feedstocks such as methane, ethane, propane, butane, mixtures of these gases, naphthas, gas oils, etc. The product stream contains a variety of components the concentration of which are dependent in part upon the feed selected. In the conventional pyrolysis process, vaporized feedstock is fed together with dilution steam to a tubular reactor located within the fired heater. The quantity of dilution steam required is dependent upon the feedstock selected; lighter feedstocks such as ethane require lower steam (0.2 lb./lb. feed), while heavier feedstocks such as naphtha and gas oils require steam/feed ratios of 0.5 to 1.0. The dilution steam has the dual function of lowering the partial pressure of the hydrocarbon and reducing the carburization rate of the pyrolysis coils.

In a typical pyrolysis process, the steam/feed mixture is preheated to a temperature just below the onset of the cracking reaction, typically 650° C. This preheat occurs in the convection section of the heater. The mix then passes to the radiant section where the pyrolysis reactions occur. Generally the residence time in the pyrolysis coil is in the range of 0.2 to 0.4 seconds and outlet temperatures for the reaction are on the order of 700° to 900° C. The reactions that result in the transformation of saturated hydrocarbons to olefins are highly endothermic thus requiring high levels of heat input. This heat input must occur at the elevated reaction temperatures. It is generally recognized in the industry that for most feedstocks, and especially for heavier feedstocks such as naphtha, shorter residence times will lead to higher selectivity to ethylene and propylene since secondary degradation reactions will be reduced. Further it is recognized that the lower the partial pressure of the hydrocarbon within the reaction environment, the higher the selectivity.

The flue gas temperatures in the radiant section of the fired heater are typically above 1,100° C. In a conventional design, approximately 32% to 40% of the heat fired as fuel into the heater is transferred into the coils in the radiant section. The balance of the heat is recovered in the convection section either as feed preheat or as steam generation. Given the limitation of small tube volume to achieve short residence times and the high temperatures of the process, heat transfer into the reaction tube is difficult. High heat fluxes are used and the operating tube metal temperatures are close to the mechanical limits for even exotic metallurgies. In most cases, the allowable maximum tube metal temperatures limit the extent to which residence time can be reduced as a result of a combination of higher process temperatures required at the coil outlet and the reduced tube length (hence tube surface area) which results in higher flux and thus higher tube metal temperatures. The exotic metal reaction tubes located in the radiant section of the cracking heater represent a substantial portion of the cost of the heater so it is important that they be utilized fully. Utilization is defined as operating at as high and as uniform a heat flux and metal temperature as possible consistent with the design objectives of the heater. This will minimize the number and length of the tubes and the resulting total metal required for a given pyrolysis capacity.

In the design of ethylene cracking heaters, the process coils are suspended between two planes of firing. In the majority of cracking furnaces, at least a portion of the heat is supplied by hearth or floor burners that are installed on the floor of the firebox. Fuel and air are injected vertically into the firebox from the burners up along the walls and combustion occurs within the firebox in an essentially vertical direction up the walls. In a properly designed system, all of the combustion takes place in this vertical direction against the wall. The balance of the heat is supplied by burners located in the vertical walls and designed to fire radially along the vertical wall.

Typically a plurality of both hearth (floor) burners and wall burners are used to heat the wall which re-radiates that heat to the process coil. The flow of combusting gases in these heaters is essentially vertically up along the wall. This vertical flow results in a recirculation zone in which at some height above the hearth, the gas moves toward the coil plane, flows in a downward direction along the coil plane and then re-enters the vertical burner air flow. This recirculation pattern satisfies the momentum balance at the burners.

While combustion is taking place within this vertical flow of gases, it is desired to keep the combusting gases or flames against the wall and complete the combustion prior to reaching the top of the recirculation zone. This avoids "flame rollover" where the flame turns inwardly toward the centrally located vertical process coil tube-bank through which the process fluid flows. A flame is defined as a flow of gases that are still undergoing combustion reactions and is distinct from the hot gases wherein the combustion has been completed. While combustion is taking place, the combusting gases have higher temperatures. This heat is transferred to the fully combusted gases (flue gases) also within the box and ultimately to the process coils. If a "flame" contacts the process coil, higher than desired heat flux to the tubes and higher than desired tube metal temperatures can result. This in turn will lead to higher rates of coking (over-reaction) inside the tube at that point and limit the run-length or it will lead to carburization of the coil and mechanical failure at that point. Either way, it is not a desirable result. Therefore, the burners must be designed such that the combustion is finished prior to reaching the top of the recirculation or vortex zone.

In general, prior art burners were able to keep the combustion against the wall by imparting a vertical velocity to the airflow and initiating the combustion inside the burner throat. This created a vertical acceleration that allowed the combustion to be completed prior to the flame rolling over toward the coil plane and into the recirculation pattern. However, that was not always true and is not generally true for the new lower $NO_x$ combustion type burners. In these low $NO_x$ burners, the combustion is staged and purposely moved outside the main burner throat area. The main burners are fired with all of the air required but with a reduced or lean fuel flow. The additional fuel required is then injected separately into the burning mixture. This staged or delayed combustion results in lower maximum flame temperatures and reduced $NO_x$ production. There is also less intense vertical momentum being imparted by the staged combustion. In many cases as a result of fuel staging, the combustion is not completed by the top of the recirculation zone. Further, as a result of the lower vertical momentum, the recirculation zone is located lower in the heater. Thus the combination of slower combustion and lower recirculation zone height lead to flame rollover and the severe negative consequences on the process coil.

SUMMARY OF THE INVENTION

The present invention relates to pyrolysis heaters, particularly for the cracking of hydrocarbons for the production of olefins, with a burner arrangement in the firebox including fuel injection ports to straighten the vertical flame and prevent flame rollover. In particular, the invention involves the introduction of a portion of the fuel supply along the walls of the heater at locations above the main burners and between the walls and the main burner flame.

DESCRIPTION OF THE PRIOR ART AND EMBODIMENTS OF THE INVENTION

Figure 1:
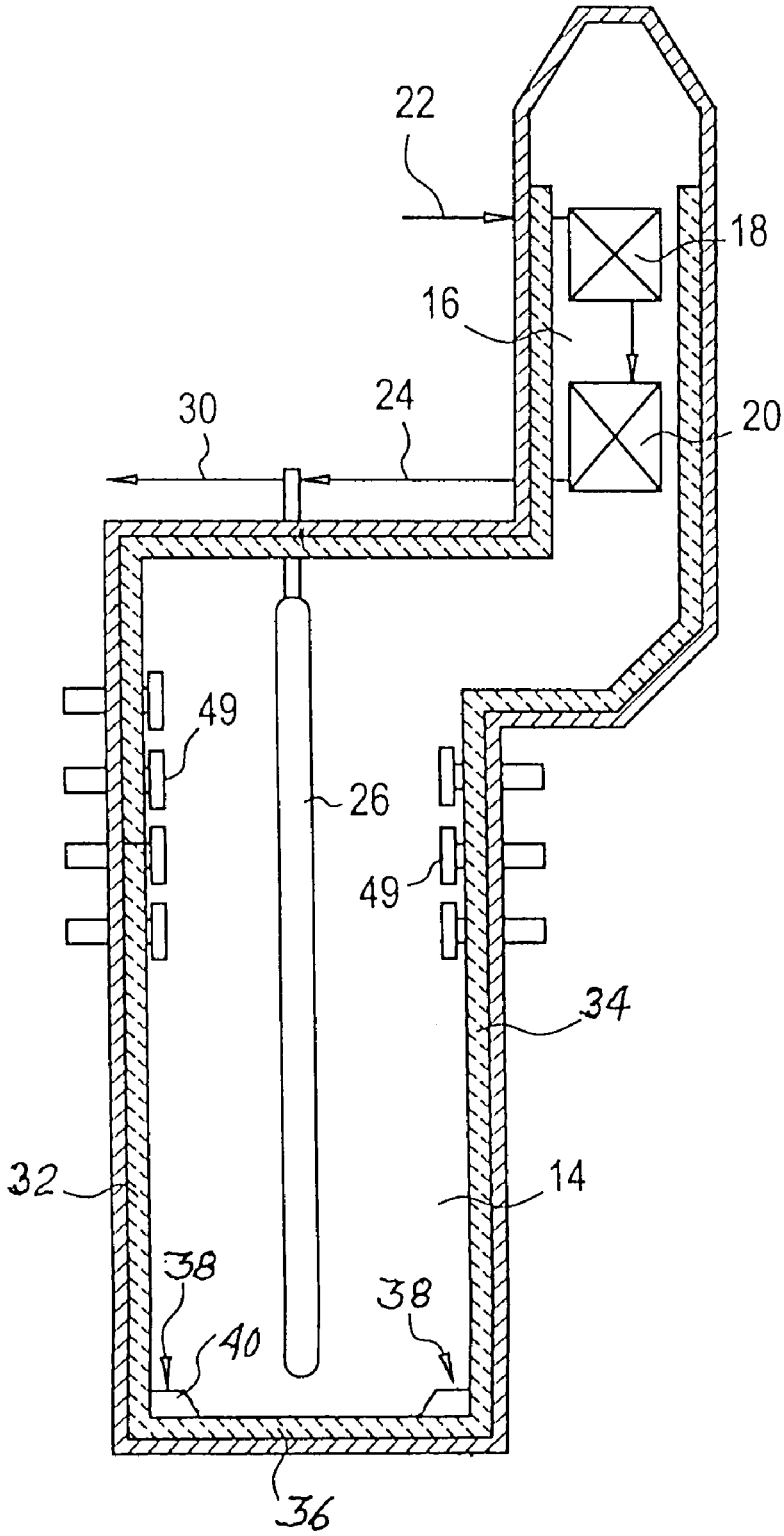
FIG. 1 PRIOR ART
FIG. 1 is a simplified vertical cross-section representation of a typical pyrolysis heater.

Before describing the details of the preferred embodiments of the present invention, a typical prior art pyrolysis heater will be described. FIG. 1 shows a cross section of such a prior art heater. This heater has a radiant heating zone 14 and a convection heating zone 16. Located in the convection heating zone 16 are the heat exchange surfaces 18 and 20 which in this case are illustrated for preheating the hydrocarbon feed 22. This zone may also contain heat exchange surface for producing steam. The preheated feed from the convection zone is fed at 24 to the heating coil generally designated 26 located in the radiant heating zone 14. The cracked product from the heating coil 26 exits at 30.

Figure 2:
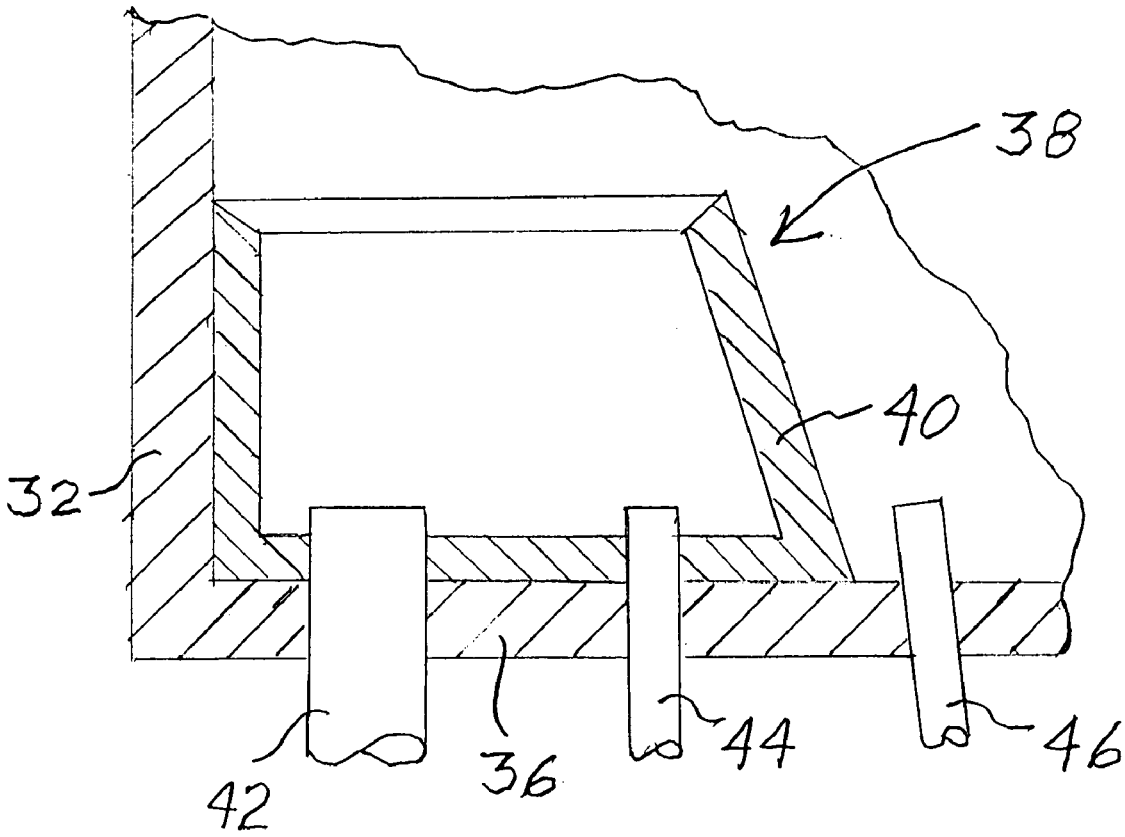
FIG. 2 PRIOR ART
FIG. 2 is a cross section of a conventional hearth burner of the prior art.

The radiant heating zone 14 comprises walls designated 32 and 34 and the floor or hearth 36. Mounted on the floor against the walls are the vertically firing main or hearth burners generally designated 38. These burners 38 are spaced along the wall. The size of a burner is determined by the individual burner firing capacity and the number of burners determined by the total fired duty required. A typical hearth burner 38 is illustrated in cross section in FIG. 2 and consists of a burner tile 40 on the hearth 36 against the wall 32 through which the main combustion air and the majority of the fuel enter the heater. Each of these burners 38 contains one or more openings 42 for the main combustion air and one or more primary fuel nozzles 44 for the fuel. In addition, there may be a spoiler to create turbulence and allow the flame to remain in the tile (not shown). There may be additional fuel nozzles 46 located outside the tile but the majority of fuel is injected into the air stream within the confines of the tile. This promotes strong vertical combustion. In addition to the hearth burners, the wall burners 49 in the upper portion of the firebox may be included. These are radiant-type burners designed to produce flat flame patterns which are spread across the walls to avoid flame impingement on the coil tubes.

Figure 3:
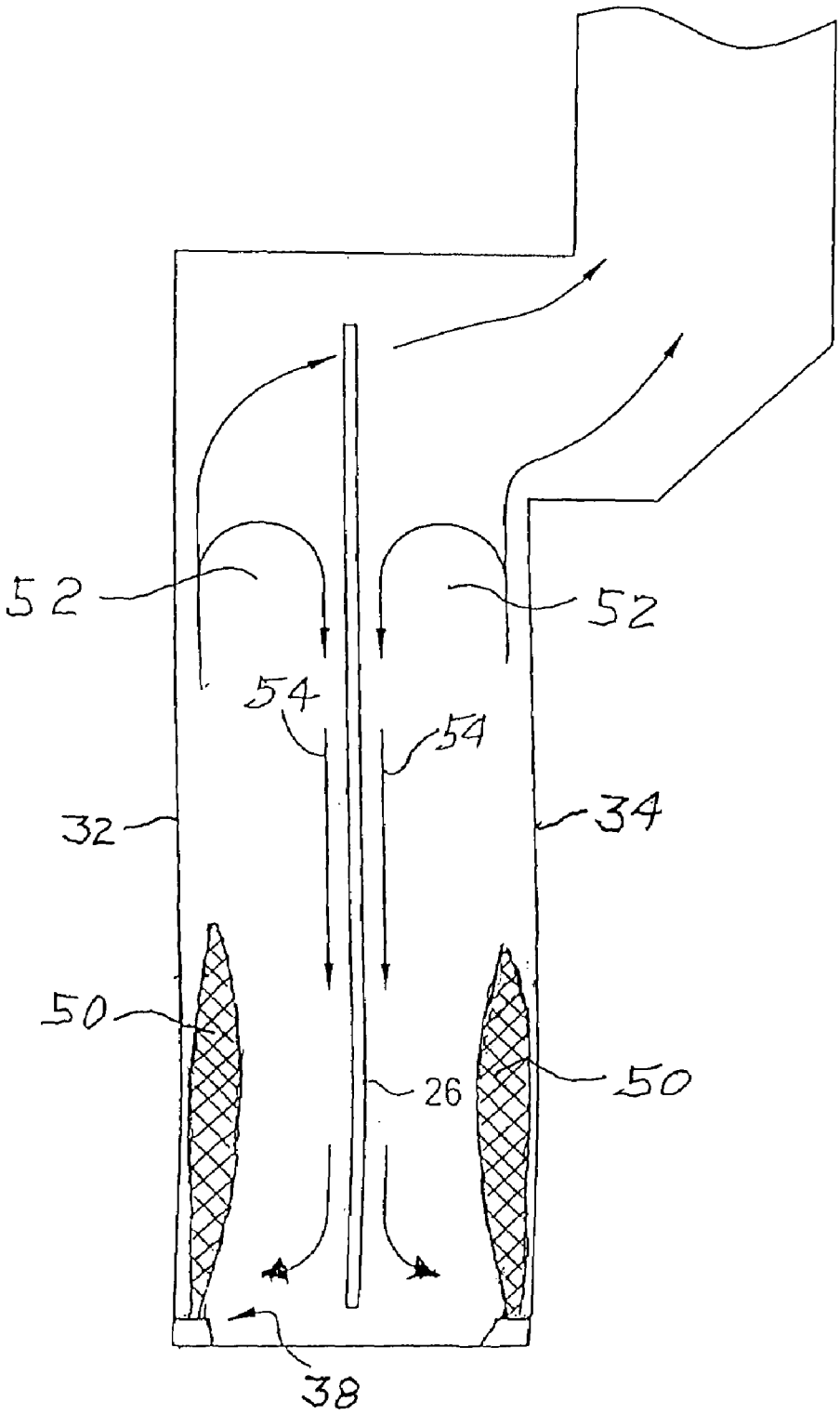
FIG. 3 PRIOR ART
FIG. 3 is a diagram of a typical flow pattern within a firebox of a prior art pyrolysis heater having hearth burners.

FIG. 3 illustrates the flame envelopes or patterns and the flue gas flow patterns inside the prior art cracking heater of FIG. 1. The flames 50 and the hot flue gases flow basically straight up from the burners 38 along the walls 32 and 34 and the combustion is completed before it reaches the recirculation zone 52. A downdraft 54 of some of the hot flue gases runs along the cooler process coils 26 in the center and splits at the bottom and feeds back into the burners. Driving forces include high-velocity fuel jets, infiltrated burner air streams and buoyancy. This twin vortex pattern is well organized and efficient, because all of the hearth burners work in concert and fire essentially vertically with no horizontal component.

Figure 4:
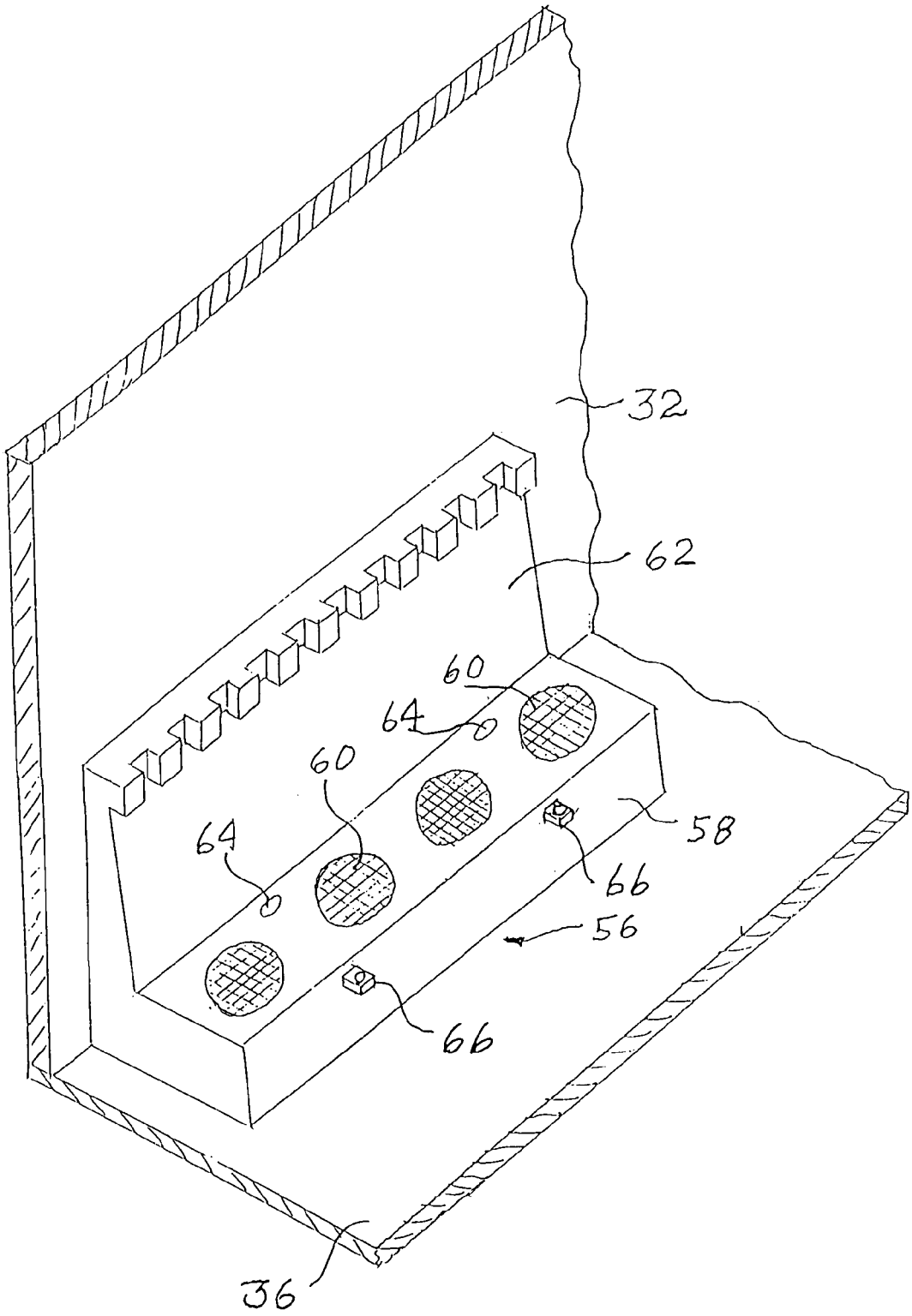
FIG. 4 PRIOR ART
FIG. 4 is a perspective view of a portion of a pyrolysis heater in the region of the hearth burners illustrating a typical low $NO_x$ burner.

As a further description of prior art, FIG. 4 is a perspective view of one version of a low $NO_x$ burner arrangement 56 for a pyrolysis heater. This low $NO_x$ burner arrangement comprises a burner tile 58 which in this case houses four main or primary burners illustrated by the primary burner ports 60. The burner tile 58 is a ceramic housing containing the burner ports which are supplied with the air and fuel from below the heater. Optionally, the burner tile 58 includes a portion 62 extending upwardly along the wall 32. This extended portion 62 serves as a flame holder or stabilizer.

All of the combustion air and the primary portion of the fuel gas are discharged into the firebox through the primary burner ports 60. There may also be additional primary fuel gas nozzles 64 where another small portion of primary fuel gas is introduced and mixed with the air and burned to stabilize the flame produced in the primary combustion zone. The quantity of primary fuel is less than the prior art case and is only sufficient to raise the temperature of the incoming stream to a level that will support combustion outside the tile. This combustion zone is air rich and thus the combustion temperature is less than the case where a close to stoichiometric fuel air mixture is used in the primary zone. The lower temperature results in lower $NO_x$ production. The remaining fuel gas is introduced into the firebox by way of the secondary fuel gas nozzles 66. The fuel gas discharged from the secondary fuel gas nozzles 66 is injected at such an angle that it mixes with primary air/fuel mixture and with cooled recirculating flue gases 54 at some distance above the tile 58 to form a fuel-air mixture diluted by those flue gases. The combustion of this secondary fuel occurs at the outside of the primary air/fuel combustion zone. A typical example of the distribution of the fuel for such low $NO_x$ burners would be 40% to the primary burners 60, 57% to the secondary fuel gas nozzles 66 and 3% to the additional primary fuel gas nozzles 64. Merely as one specific example of a low $NO_x$ burner arrangement, reference is made to U.S. patent application Publication No. US 2002/0064740 dated May 30, 2002. There are other design possibilities including simply shifting fuel from inside the tile to outside the tile in more conventional designs in order to achieve this combustion staging and thus reduced $NO_x$.

Figure 5:
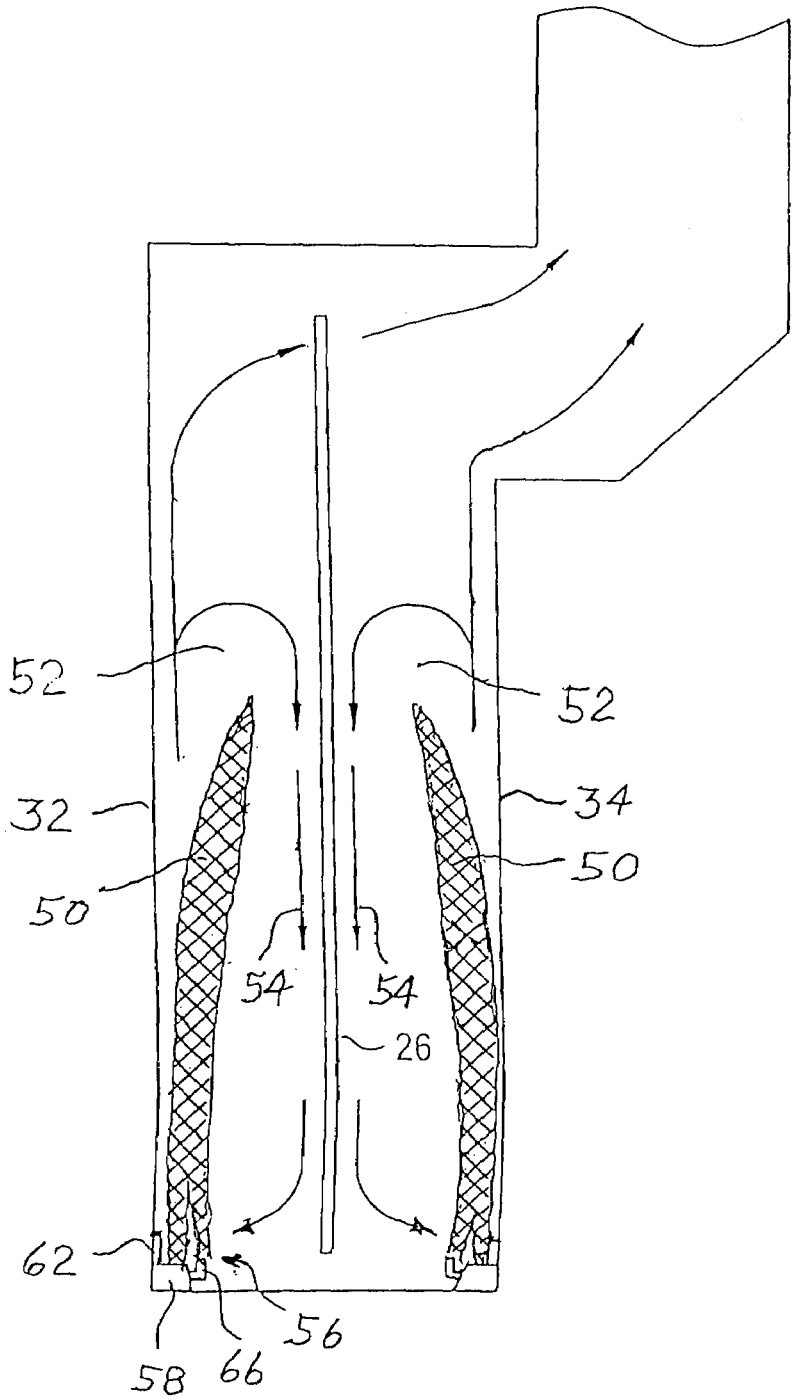
FIG. 5 PRIOR ART
FIG. 5 is a diagram of the flow pattern within the firebox for the low $NO_x$ burner of FIG. 4.
Figure 6:
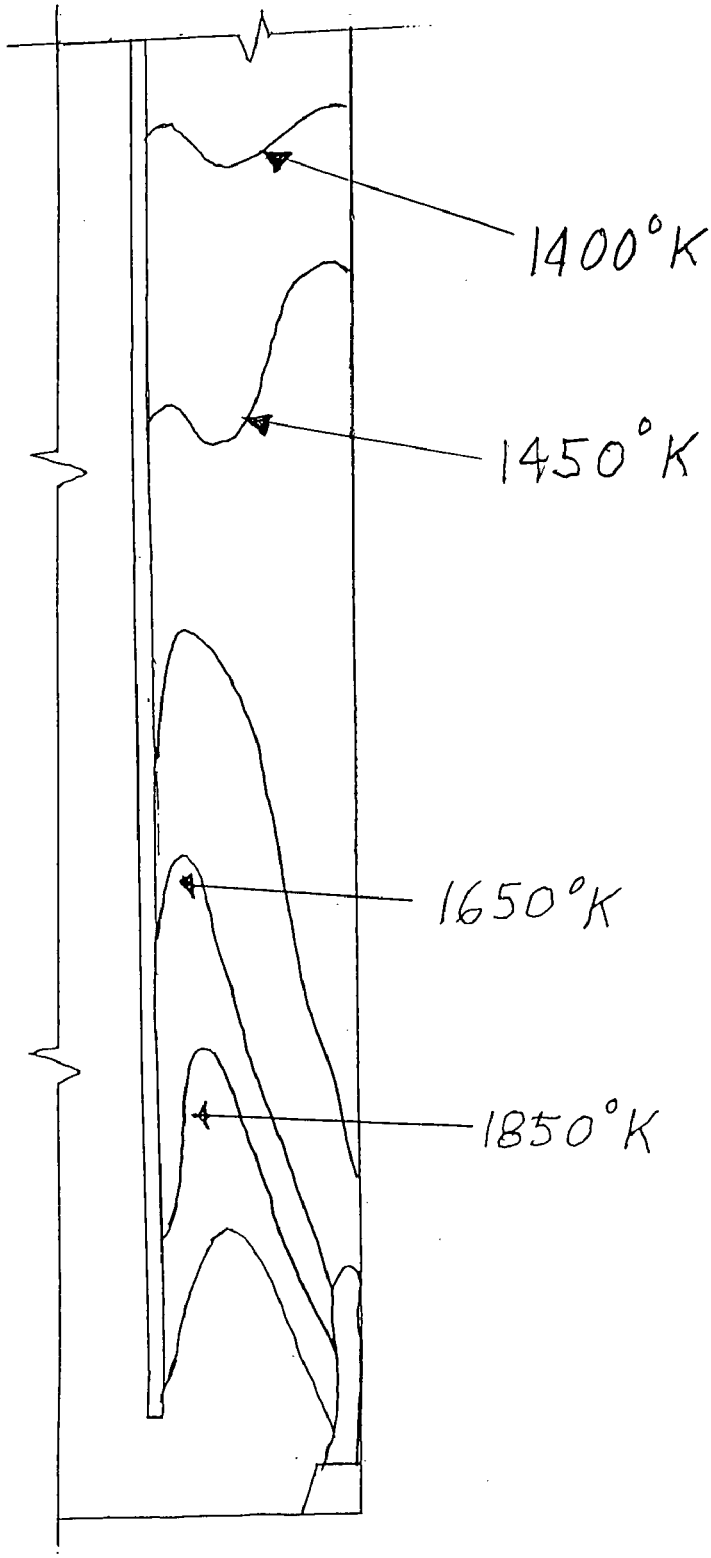
FIG. 6 shows isotherm lines for a low $NO_x$ burner as in FIG. 4.

FIG. 5 illustrates the flame patterns and the flue gas flow patterns inside of a prior art cracking heater with low $NO_x$ burners such as illustrated in FIG. 4. It can be seen that the flames 50 now extend further up into the heater due to the staged combustion and that there is rollover of the flames toward the heating coil 26. The majority of the combustion occurs outside of the tile. The acceleration of the combustion has created a lower density region on the side of the flame toward the heating coil that draws the flame toward the coil. Also, by pulling the fuel away from the primary burner ports 60 out to the secondary fuel gas nozzles 66, a colder zone is created at the wall. This colder zone has a higher density and hydrodynamically acts to push the lower density flame away from the wall toward the coil. This FIG. 4 also shows that the recirculation zone 52 has moved down. The result is that the heating coil 26 is at risk for over heating. FIG. 6 shows the isothermal temperature lines of the center plane of a low $NO_x$ burner with flame rollover. It can be seen that the temperature in the region of the coil 26 reaches well above 1600K. This high temperature creates heat transfer to the coil that can result in a coil metal temperature that exceeds 1350° K that is a typical maximum allowable metal temperature for the tubes in the coil in order to avoid failure.

Figure 7:
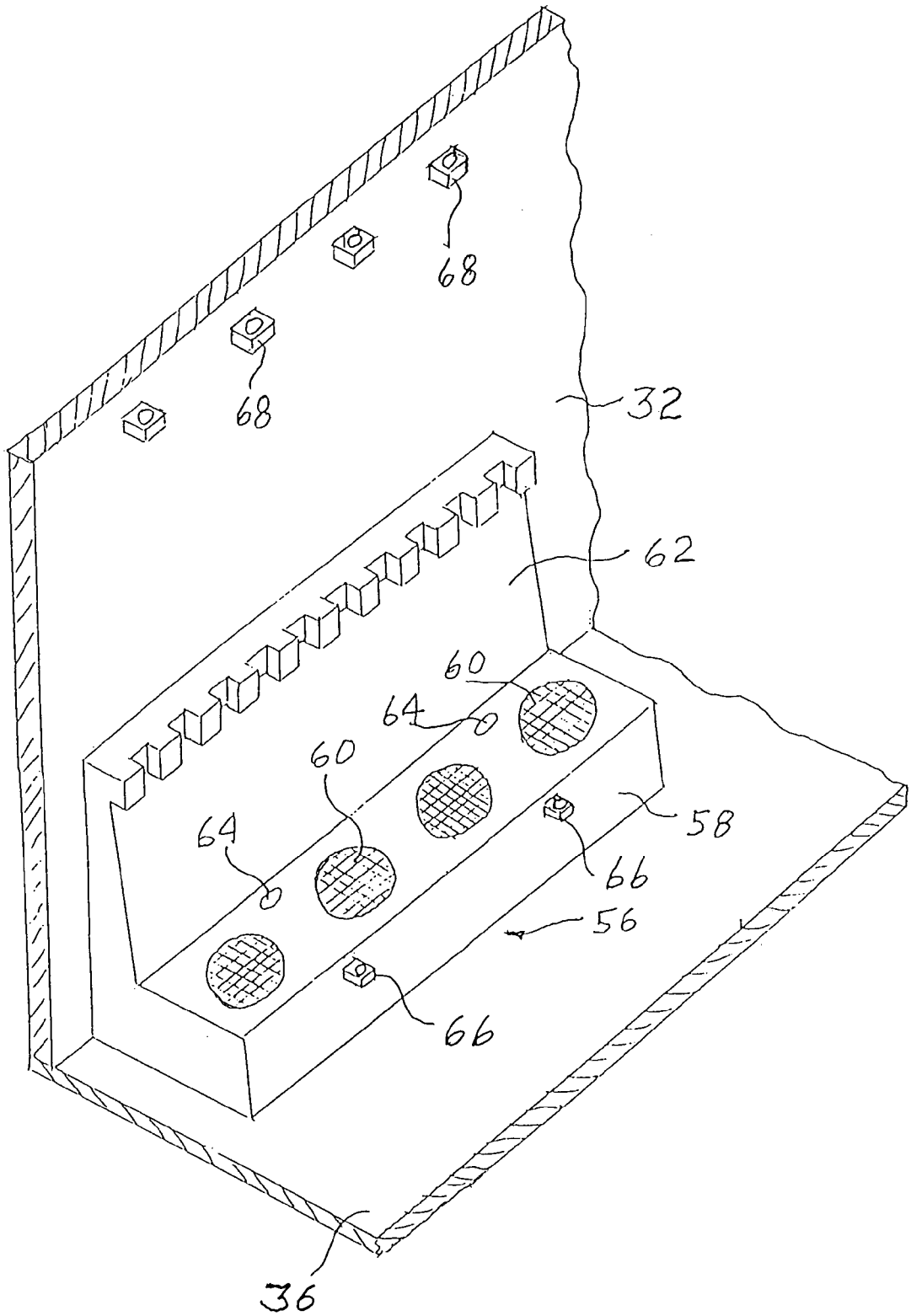
FIG. 7 is a perspective view similar to FIG. 4 but incorporating the wall stabilizing fuel gas tips of the present invention.

The present invention is illustrated in FIG. 7 which shows a hearth burner 56 which is a low $NO_x$ burner as in FIG. 4. Added to the firebox are the fuel gas injection, wall stabilizing tips 68 which fire fuel only (no air) and fire generally upward. These wall stabilizing fuel gas injection tips are located from one to ten feet and preferably about three feet above the burner tile 58. The fuel for these wall stabilizing fuel gas injection tips is preferably taken from the fuel that would normally be supplied to the secondary fuel gas nozzles 66 and is in the range of 5% to 30% and preferably about 15% of the total fuel gas feed. Each of these tips can contain a multiplicity of fuel injection orifices. A typical example of the fuel distribution would be 40% to the primary burners 60, 42% to the secondary fuel gas nozzles 66, 3% to the additional primary fuel gas nozzles 64 and 15% to the wall stabilizing fuel gas tips.

Figure 8:
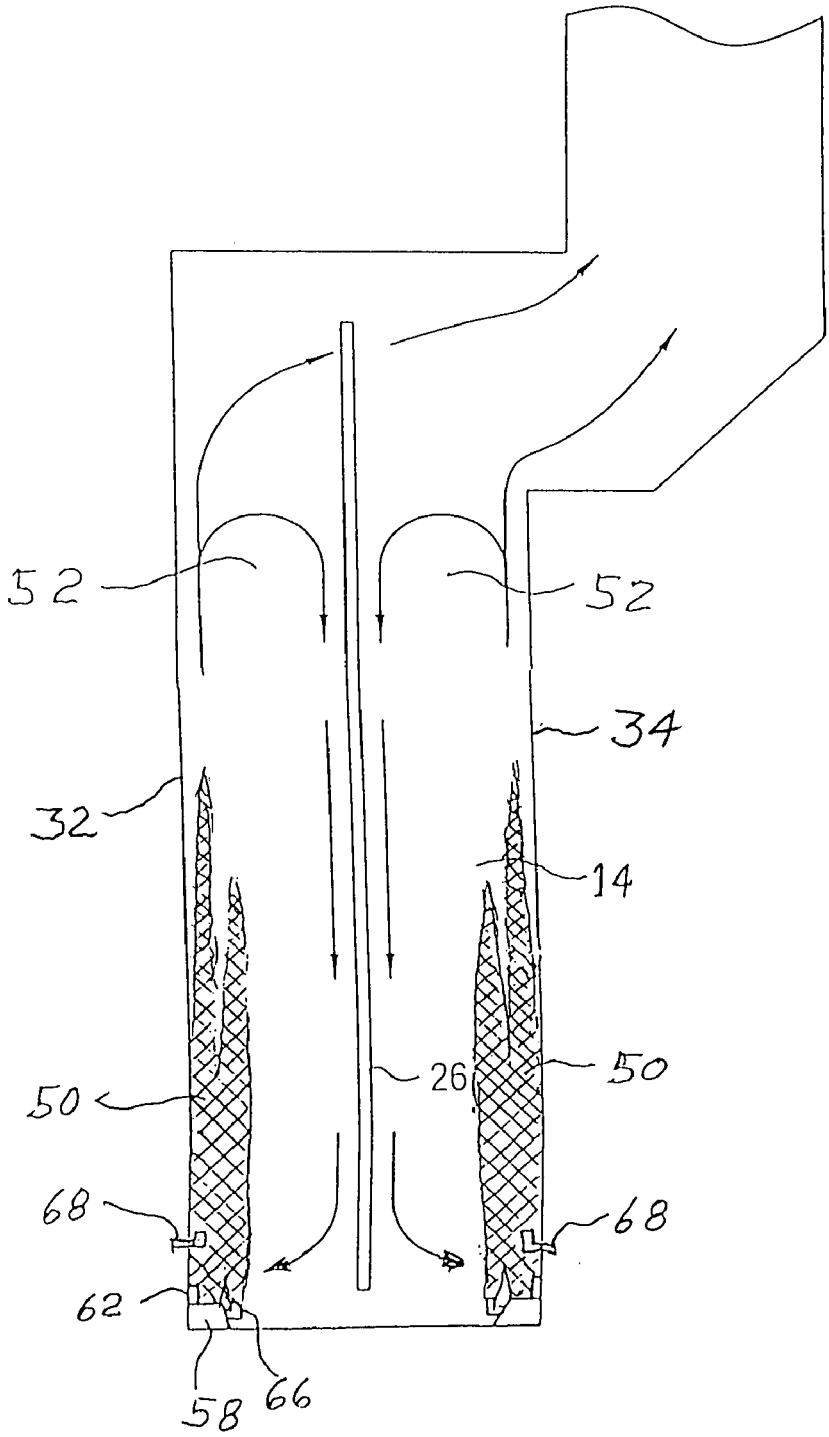
FIG. 8 is a diagram of the flow pattern within the firebox for the present invention.
Figure 9:
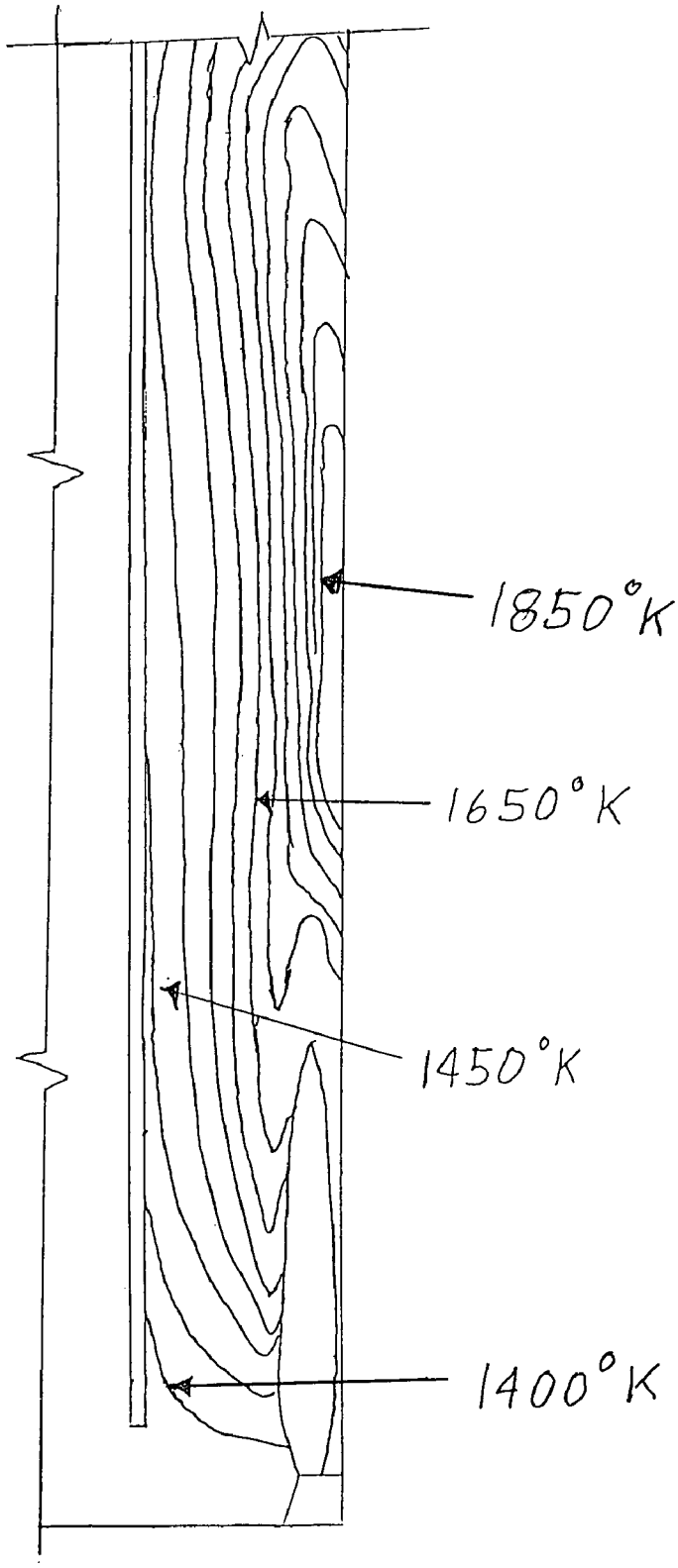
FIG. 9 shows isotherm lines for the present invention.

The effect of the wall stabilizing fuel gas tips on the combustion process is illustrated in FIG. 8. The flames 50 are now much straighter and vertical than shown in FIG. 5 and are pulled toward the walls. The combusting zone at the wall created by these fuel jets is clearly visible. Also, the recirculation zone 52 has now moved up on the heater. By injecting the fuel above the burner tile and directly along the wall, the vertical combustion can be increased while maintaining the staging effect to reduce $NO_x$. This combustion also creates a low-pressure zone at the wall that effectively pulls the flame toward the wall. FIG. 9 shows the center cut temperature isotherms. The high temperatures are now off the coil plane and pulled to the wall. The temperatures in the vicinity of the coil plane are now on the order of 1450K. This compares to the 1650–1850K temperatures in the case without wall stabilizing combustion. By reducing the temperatures at the coil plane, coil fouling and overheating can be dramatically reduced.

The following table lists the calculated maximum metal temperatures (in ° F.) for various tubes in a coil for prior art conventional burners (Design A), for prior art low $NO_x$ burners (Design B), and for two different configurations of low $NO_x$ burners with wall stabilizing fuel gas tips according to the present invention (Designs C and D). These temperatures represent the highest temperature anywhere along the length of the tube.

| Tube No. | Design A | Design B | Design C | Design D |
|---|---|---|---|---|
| | | Inlet Pass | | |
| t-1-1 | 1964 | 1988 | 1933 | 1921 |
| t-1-2 | 1894 | 1955 | 1901 | 1888 |
| t-2-1 | 1935 | 1957 | 1894 | 1882 |
| t-2-2 | 1893 | 1958 | 1891 | 1880 |
| t-3-1 | 1892 | 1960 | 1890 | 1880 |
| t-3-2 | 1890 | 1957 | 1885 | 1876 |
| t-4-1 | 1912 | 1980 | 1920 | 1913 |
| t-4-2 | 1886 | 1945 | 1891 | 1884 |
| t-5-1 | 1883 | 1992 | 1928 | 1921 |
| t-5-2 | 1883 | 1947 | 1886 | 1880 |
| t-6-1 | 1883 | 1950 | 1888 | 1881 |
| t-6-2 | 1881 | 1948 | 1885 | 1877 |
| Avg. | 1899 | 1961 | 1899 | 1890 |
| | | Outlet Pass | | |
| t-1 | 1842 | 1902 | 1846 | 1839 |
| t-2 | 1850 | 1905 | 1851 | 1844 |
| t-3 | 1856 | 1900 | 1854 | 1846 |
| t-4 | 1887 | 1897 | 1842 | 1836 |
| t-5 | 1894 | 1896 | 1846 | 1839 |
| t-6 | 1909 | 1903 | 1856 | 1845 |
| Avg. | 1873 | 1900 | 1849 | 1842 |

From the temperatures, it is clear that the present invention reduces the tube metal temperatures (Designs C and D) as compared to the tube metal temperatures for a conventional low $NO_x$ burner (Design B). In many cases, the temperatures are even lower than the basic prior art (Design A).

In cracking heaters, the rate of fouling (coking) is set by the metal temperature and its influence on the coking reactions that occur within the inner film of the process coil. The lower the metal temperature, the lower the rates of coking. The coke formed on the inner surface of the coil creates a thermal resistance to heat transfer. In order for the same process heat input to be obtained as the coil fouls, furnace firing must increase and outside metal temperature must increase to compensate for the resistance of the coke layer.

With the design of the invention, the lower temperature results in a lower fouling rate and thus the rate that the firing must be increased to compensate is lower. In addition, the metallurgy of the cracking coils defined a fixed limit on maximum temperature at any one location along the coil in order to avoid tube failure. By utilizing the invention not only is the rate of fouling reduced, but the allowable temperature increase to the fixed limit is increased. This leads to a longer cycle length for the cracking heater and improved economic performance.

Although the invention has been described with reference to hearth burners which are typically considered to be low $NO_x$ burners and to certain low $NO_x$ burner arrangements and details, the present invention is not limited to such burners or their arrangements or details. The invention covers any combination of hearth burners and wall stabilizing fuel gas tips where the hearth burners are fired lean with all of the primary combustion air but with less than the stoichiometric quantity of fuel and where the remaining fuel is fired via the wall stabilizing fuel gas tips located on the walls above the hearth burners. The hearth burners can be located in any pattern along the walls of the radiant chamber with the important element being that the injection of the wall stabilizing fuel is only directly above the hearth burners.

The invention claimed is:

1. A method of operating a pyrolysis heater for the pyrolysis of hydrocarbons in the production of olefins wherein said heater comprises:

a. a radiant heating zone having a bottom hearth and opposing walls;

b. at least one tubular heating coil for processing said hydrocarbons located in said radiant heating zone between said opposing walls;

c. a plurality of hearth burners located on said hearth adjacent to each of said walls and directed upwardly for firing flame envelopes vertically up along said walls through said radiant heating zone; and d. a plurality of wall stabilizing fuel gas tips located on said walls above said hearth burners for injecting fuel gas upwardly between said walls and said flame envelopes;

said method comprising the steps of firing said plurality of hearth burners with the combustion air and less than the stoichiometric amount of fuel gas and injecting additional fuel gas into said radiant heating zone through said wall stabilizing fuel gas tips to provide the stoichiometric quantity of fuels stage the combustion, and create a low pressure zone at said walls.

2. A method as recited in claim 1 wherein said fuel gas injected through said wall stabilizing fuel gas tips comprises from 5% to 30% of the stoichiometric quantity of fuel gas.

3. A method as recited in claim 1 wherein said wall stabilizing fuel gas tips and the resulting location of injecting said additional fuel gas are from 1 to 10 feet above said hearth burners.

4. A method as recited in claim 3 wherein said wall stabilizing fuel gas tips and the resulting location of injecting said additional fuel gas are about 3 feet above said hearth burners.

5. A method as recited in claim 1, wherein the injection of additional fuel gas through said wall stabilizing fuel gas tips prevents flame rollover.

6. A method as recited in claim 1, wherein said heater comprises a recirculation zone and injection of additional fuel gas through said wall stabilizing fuel gas tips moves the recirculation zone upwardly in the heater.

7. A method as recited in claim 1, wherein at least one hearth burner is a low $NO_x$ burner.

8. A method as recited in claim 1, wherein each of the plurality of hearth burners is a low $NO_x$ burner.

9. A pyrolysis heater for the pyrolysis of hydrocarbons comprising:

a. a radiant heating zone having a bottom hearth and opposing side walls;

b. at least one tubular heating coil for processing said hydrocarbons located in said radiant heating zone between said opposing walls;

c. a plurality of hearth burners located on said hearth adjacent to each of said walls and directed upwardly for firing vertically up along said side walls through said radiant heating zone and adapted to fire combustion air and less than the stoichiometric amount of fuel gas; and d. a plurality of wall stabilizing fuel gas tips located on said walls above said hearth burners adapted to inject additional fuel gas upwardly along said walls to create a low pressure zone at said walls.

10. A pyrolysis heater as recited in claim 9 wherein said wall stabilizing fuel gas tips are from 1 to 10 feet above said hearth burners.

11. A pyrolysis heater as recited in claim 10 wherein said wall stabilizing fuel gas tips are about 3 feet above said hearth burners.

12. A pyrolysis heater as recited in claim 9, wherein the wall stabilizing fuel gas tips are adapted to prevent flame rollover.

13. A pyrolysis heater as recited in claim 9, wherein said heater comprises a recirculation zone and injection of additional fuel gas through said wall stabilizing fuel gas tips moves the recirculation zone upwardly in the heater.

14. A pyrolysis heater as recited in claim 9, wherein at least one hearth burner is a low $NO_x$ burner.

15. A pyrolysis heater as recited in claim 9, wherein each of the plurality of hearth burners is a low $NO_x$ burner.

* * * * *

UNITED STATES PATENT AND TRADEMARK OFFICE

CERTIFICATE OF CORRECTION

PATENT NO. : 7,172,412 B2
APPLICATION NO. : 10/717087
DATED : February 6, 2007
INVENTOR(S) : Platvoet et al.

It is certified that error appears in the above-identified patent and that said Letters Patent is hereby corrected as shown below:

Column 7:

Line 25, before "stage" delete "fuels" and insert --fuel,--.

Signed and Sealed this

Fourteenth Day of August, 2007

JON W. DUDAS
*Director of the United States Patent and Trademark Office*